US008919440B2

(12) United States Patent
Brekke

(10) Patent No.: US 8,919,440 B2
(45) Date of Patent: Dec. 30, 2014

(54) SYSTEM AND METHOD FOR DETECTING SCREEN-OUT USING A FRACTURING VALVE FOR MITIGATION

(71) Applicant: Kristian Brekke, Bellaire, TX (US)

(72) Inventor: Kristian Brekke, Bellaire, TX (US)

( * ) Notice: Subject to any disclaimer, the term of this patent is extended or adjusted under 35 U.S.C. 154(b) by 61 days.

(21) Appl. No.: 13/624,981

(22) Filed: Sep. 24, 2012

(65) Prior Publication Data

US 2014/0083680 A1 Mar. 27, 2014

(51) Int. Cl.

| | |
|---|---|
| ***E21B 43/26*** | (2006.01) |
| ***E21B 34/10*** | (2006.01) |
| ***E21B 34/06*** | (2006.01) |

(52) U.S. Cl.

CPC ..... *E21B 34/10* (2013.01); *E21B 34/063* (2013.01); *E21B 43/26* (2013.01)

USPC ..... 166/250.1; 166/177.5; 166/308.1; 166/332.4

(58) Field of Classification Search

USPC ..... 166/308.1, 374, 386, 177.5, 320, 332.4, 166/250.1

See application file for complete search history.

(56) References Cited

U.S. PATENT DOCUMENTS

| | | | | |
|---|---|---|---|---|
| 2,923,562 | A * | 2/1960 | Bagnell et al. | 285/316 |
| 6,386,289 | B1 * | 5/2002 | Patel | 166/325 |
| 7,090,020 | B2 * | 8/2006 | Hill et al. | 166/373 |
| 7,490,669 | B2 * | 2/2009 | Walker et al. | 166/313 |
| 7,802,627 | B2 * | 9/2010 | Hofman et al. | 166/386 |
| 8,356,671 | B2 * | 1/2013 | Guillory et al. | 166/318 |
| 8,540,019 | B2 * | 9/2013 | Hofman et al. | 166/177.5 |
| 2004/0084190 | A1 * | 5/2004 | Hill et al. | 166/386 |
| 2004/0163820 | A1 * | 8/2004 | Bishop et al. | 166/373 |
| 2004/0238173 | A1 * | 12/2004 | Bissonnette et al. | 166/307 |
| 2005/0121192 | A1 * | 6/2005 | Hailey et al. | 166/278 |
| 2006/0213670 | A1 * | 9/2006 | Bishop et al. | 166/386 |
| 2007/0084605 | A1 * | 4/2007 | Walker et al. | 166/313 |
| 2007/0204995 | A1 * | 9/2007 | Hofman et al. | 166/308.1 |
| 2011/0100643 | A1 * | 5/2011 | Themig et al. | 166/373 |
| 2011/0240301 | A1 * | 10/2011 | Robison et al. | 166/334.1 |
| 2011/0240311 | A1 * | 10/2011 | Robison et al. | 166/373 |
| 2011/0315390 | A1 * | 12/2011 | Guillory et al. | 166/329 |
| 2012/0097397 | A1 * | 4/2012 | Hofman et al. | 166/308.1 |
| 2012/0097398 | A1 * | 4/2012 | Ravensbergen et al. | 166/308.1 |
| 2012/0111574 | A1 * | 5/2012 | Desranleau et al. | 166/373 |
| 2012/0305265 | A1 * | 12/2012 | Garcia et al. | 166/373 |
| 2013/0168099 | A1 * | 7/2013 | Themig | 166/308.1 |
| 2013/0220603 | A1 * | 8/2013 | Robison et al. | 166/250.04 |
| 2013/0248189 | A1 * | 9/2013 | Brekke | 166/308.1 |
| 2013/0248190 | A1 * | 9/2013 | Brekke | 166/308.1 |
| 2013/0248193 | A1 * | 9/2013 | Brekke | 166/317 |
| 2014/0014347 | A1 * | 1/2014 | Adam et al. | 166/308.1 |
| 2014/0034294 | A1 * | 2/2014 | Hofman et al. | 166/177.5 |
| 2014/0083680 | A1 * | 3/2014 | Brekke | 166/250.01 |
| 2014/0083689 | A1 * | 3/2014 | Streich et al. | 166/250.15 |

* cited by examiner

*Primary Examiner* — Jennifer H Gay

(74) *Attorney, Agent, or Firm* — Spradley PLLC; Michael Spradley

(57) ABSTRACT

A system and method for detecting screen-out using a fracturing valve for mitigation, wherein the fracture method can comprise fracturing a well using a fracturing valve, while a downhole pressure is less than a predetermined threshold. The method can also comprise actuating by automated process the fracturing valve from a fracturing position to a non-fracturing position upon detecting by a pressure sensor in the wellbore that the downhole pressure has reached said predetermined threshold.

8 Claims, 14 Drawing Sheets

SYSTEM AND METHOD FOR DETECTING SCREEN-OUT USING A FRACTURING VALVE FOR MITIGATION

BACKGROUND

This disclosure relates to a system and method for detecting screen-out using a fracturing valve for mitigation.

Over the years, hydraulic fracturing with multiple fractures has been a popular method in producing gas and oil from a horizontal wells. Hydraulic fracturing involves injecting a highly pressurized fracturing fluid through a wellbore, which causes rock layers to fracture. Once cracks are formed, proppants are introduced to the injected fluid to prevent fractures from closing. The proppants use particulates, such as grains of sands or ceramics, which are permeable enough to allow formation fluid to flow to the channels or wells.

However, during a fracturing operation, major problems, such as screen-outs, can occur. Screen-outs happen when a continued injection of fluid into the fracture requires pressure beyond the safe limitations of the wellbore and surface equipment. This condition takes place due to high fluid leakage, excessive concentration of proppants, and an insufficient pad size that blocks the flow of proppants. As a result, pressure rapidly builds up. Screen-out can disrupt a fracturing operation and require cleaning of the wellbore before resuming operations. A delay in one fracturing operation can cause disruption on the completion and production of subsequent fractures.

The consequences of screen-out can depend on the type of completion used in fracturing. One of the common completions used for horizontal well is open hole liner completion. This involves running the casing directly into the formation so that no casing or liner is placed across the production zone. This method for fracturing can be quick and inexpensive. Open hole liner completion can also include the use of a ball-actuated sliding sleeve system, commonly used for multistage fracturing. However, if screen-out occurs near the toe of a horizontal wellbore, the small openings of the ball seats can make it difficult to use a coiled tubing or a workover string to wash the proppants out. One initial solution can include opening the well and waiting for the fracturing fluid to flow back. However, if the flow back does not occur, the only solution left is to mill out the completion and apply a different completion scheme to the wellbore. As a result, the entire operation can cause delays and higher expenses.

Another known completion method is a plug-and-perforate system, which is closely similar to the open hole liner system. This method involves cementing the liner of the horizontal wellbore and is often performed at a given horizontal location near the toe of the well. The plug and perforate method involves the repetitive process of perforating multiple clusters in different treatment intervals, pulling them out of a hole, pumping a high rate stimulation treatment, and setting a plug to isolate the interval, until all intervals are stimulated. The consequences of screen-out in this method may not be as severe compared to the ball-actuated sliding sleeve system, since the well can be accessed with coiled tubing to wash the proppants out.

Yet, another method used has included cemented liner completions with restricted entry. Cemented liner completions with restricted entry involve controlling fluid entry into a wellbore. This method provides a cemented liner or casing comprising a cluster of limited openings that can allow fluid communication between a region of a wellbore and the formation. However, a poor connection between the well and the formation often results in screen-out. Thus, screen out encountered in each completion method adds costs and causes disruption in fracturing operations and production.

As such, it would be useful to have an improved system and method for detecting screen-out using a fracturing valve for mitigation.

SUMMARY

This disclosure relates to a system and method for detecting screen-out using a fracturing valve for mitigation. The fracture method can comprise fracturing a well using a fracturing valve, while a downhole pressure is less than a predetermined threshold. The method can also comprise actuating by automated process the fracturing valve from a fracturing position to a nonfracturing position upon detecting by a pressure sensor in the wellbore that the downhole pressure has reached said predetermined threshold.

The fracturing valve system can comprises a base pipe comprising an insert port capable of housing a stop ball, as the stop ball can be insertable partially within the chamber of the base pipe. Additionally, the system can comprise a sliding sleeve comprising a first sleeve with an inner surface having an angular void and a large void. The first sleeve can be maneuverable into multiple positions, In a first position, an angular void can rest over the insert port, preventing the stop ball from exiting the chamber of the base pipe. In a second position, where the large void rests over the insert port, the stop ball can be capable of exiting the chamber of the base pipe to enter the large void.

Additionally, a method of detecting screen out using a fracturing valve is disclosed. Specifically, the method can comprise injecting a fracturing fluid into said fracturing valve, which comprises a base pipe and a sliding sleeve. The base pipe can comprise one or more insert ports each capable of housing a stop ball. The sliding sleeve can comprise an inner surface with an angular void and a large void, as the sliding sleeve initially in a first position, where the angular void rests over said insert port. The method can further comprise applying a first force on the frac ball by the fracturing fluid, applying a second force on one or more stop balls by the frac ball, and applying a third force against the angular void by the stop balls. Furthermore, the method can comprise biasing the sliding sleeve, at least in part by a third force, toward a second position, where a large void rests over the insert port. Thus, the stop ball can be capable of exiting the chamber of the base pipe to enter the large void.

DETAILED DESCRIPTION

Described herein is a system and method for detecting screen-out using a fracturing valve for mitigation. The following description is presented to enable any person skilled in the art to make and use the invention as claimed and is provided in the context of the particular examples discussed below, variations of which will be readily apparent to those skilled in the art. In the interest of clarity, not all features of an actual implementation are described in this specification. It will be appreciated that in the development of any such actual implementation (as in any development project), design decisions must be made to achieve the designers' specific goals (e.g., compliance with system- and business-related constraints), and that these goals will vary from one implementation to another. It will also be appreciated that such development effort might be complex and time-consuming, but would nevertheless be a routine undertaking for those of ordinary skill in the field of the appropriate art having the benefit of this disclosure. Accordingly, the claims appended hereto are not intended to be limited by the disclosed embodiments, but are to be accorded their widest scope consistent with the principles and features disclosed herein.

Figure 1B:
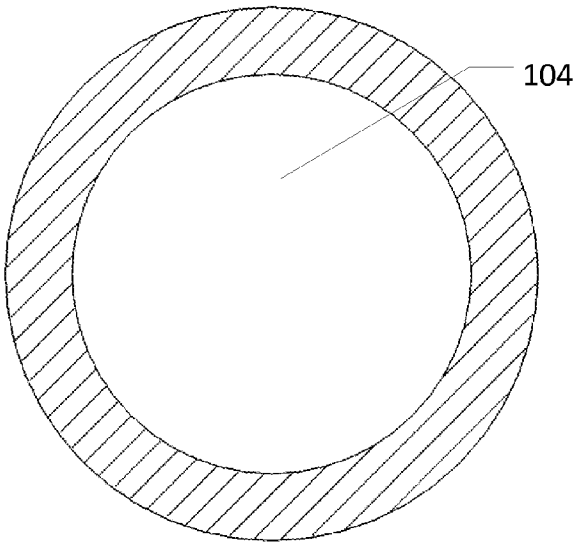
FIG. 1B illustrates a cross-sectional view of a base pipe.
Figure 1A:
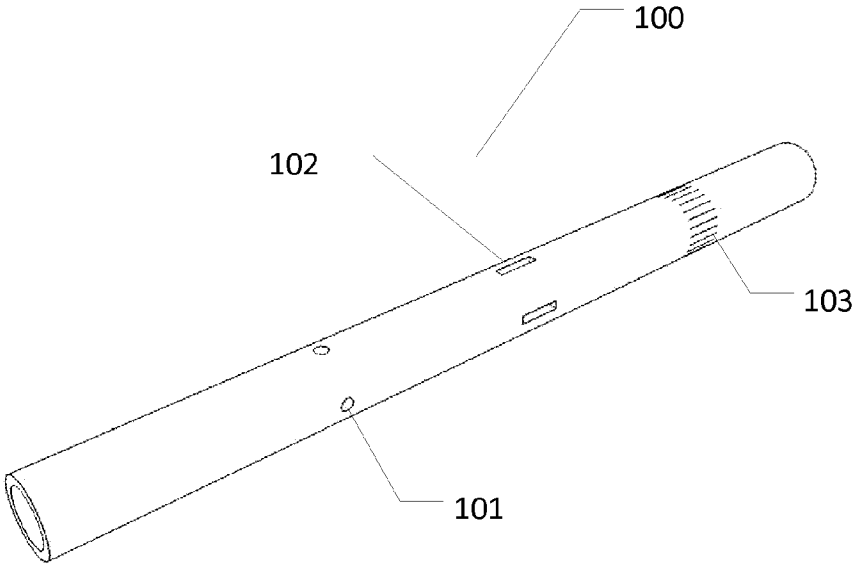
FIG. 1A illustrates a side view of a base pipe.

FIG. 1A illustrates a side view of a base pipe 100. Base pipe 100 can be connected as a portion of a pipe string. In one embodiment, base pipe 100 can comprise cylindrical material with different wall openings and/or slots. Base pipe 100 wall openings can comprise an insert port 101, a fracturing port 102, and/or a production port 103. Insert port 101 can be made of one or more small openings in a base pipe 100. Fracturing port 102 can also comprise one or more openings. Furthermore, production port 103 can be a plurality of openings in base pipe 100.

Figure 1C:
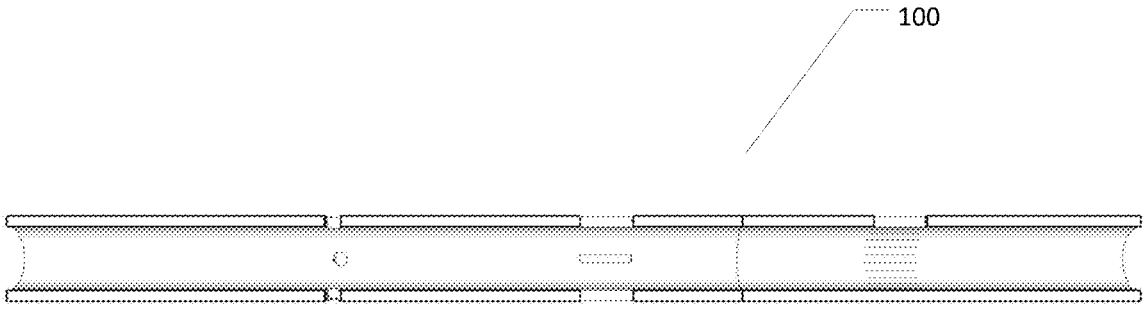
FIG. 1C illustrates a cross sectional view of a base pipe.

FIG. 1B illustrates a front view of base pipe 100. Base pipe 100 can further comprise a chamber 104. Chamber 104 can be a cylindrical opening or a space created inside base pipe 100. Chamber 104 can allow material, such as fracturing fluid or hydrocarbons, to pass through. FIG. 1C illustrates a cross-sectional view of a base pipe 100. Each wall opening discussed above can be circularly placed around base pipe 100.

Figure 2A:
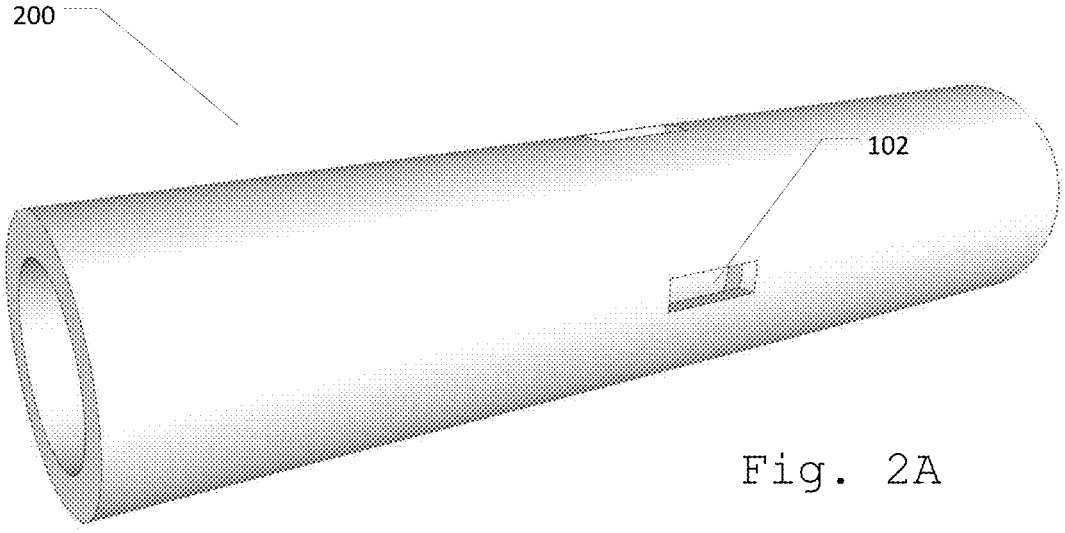
FIG. 2A illustrates a sliding sleeve.

FIG. 2A illustrates a sliding sleeve 200. Sliding sleeve 200 can be connected to a fixed sleeve 205 by an actuator 206, while sliding sleeve 200 can be in line with an outer ring 207. In one embodiment, sliding sleeve 200 can be a cylindrical tube that can comprise fracturing port 102. Thus, fracturing port can have a first portion within base pipe 101 and a second portion within sliding sleeve 200.

Figure 2B:
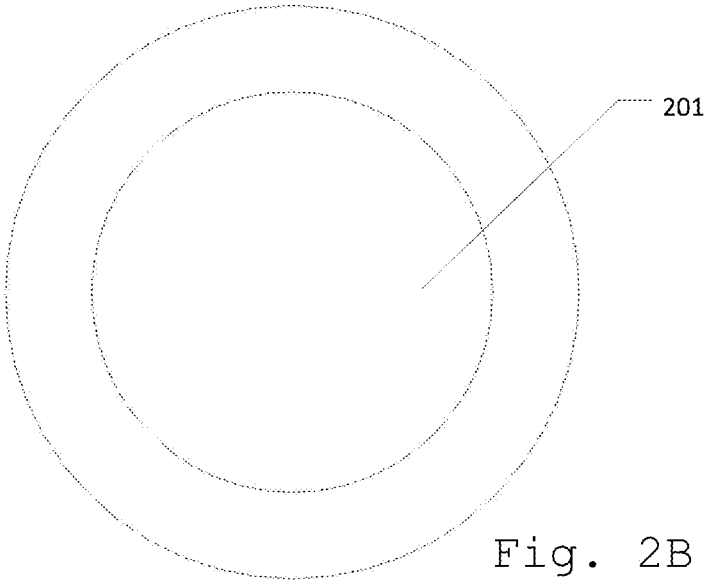
FIG. 2B illustrates a cross-sectional view of a sliding sleeve.

FIG. 2B illustrates a front view of a sliding sleeve 200. Sliding sleeve 200 can further comprise an outer chamber 201. In one embodiment, outer chamber 201 can be an opening larger than chamber 104. As such, chamber 201 can be large enough to house base pipe 100.

Figure 2C:
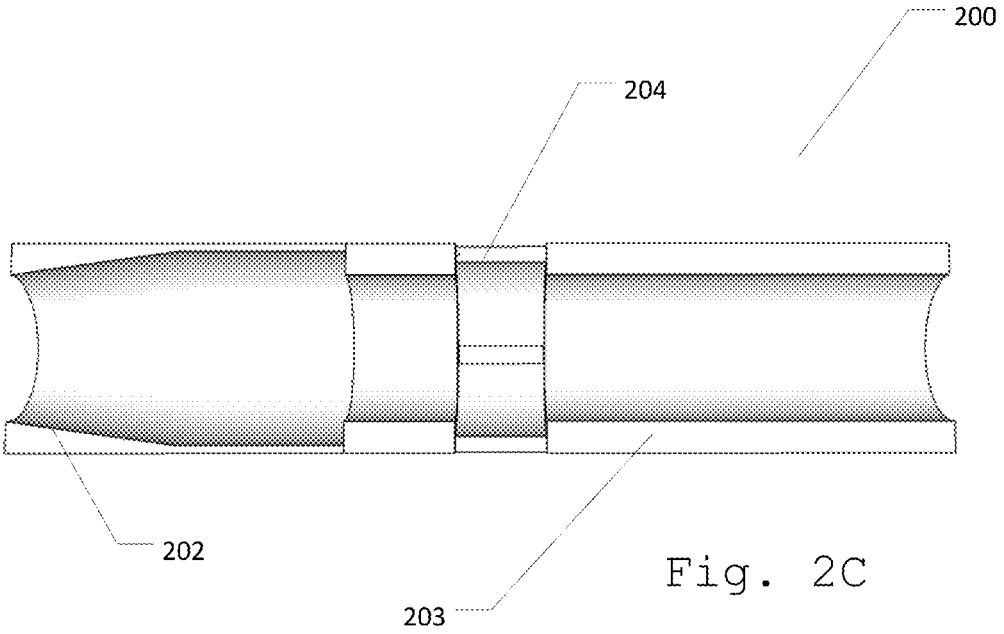
FIG. 2C illustrates a cross sectional view of a sliding sleeve.

FIG. 2C illustrates a cross-sectional view of a sliding sleeve 200. Sliding sleeve 200 can comprise a first sleeve 202 and a second sleeve 203. First sleeve 202 and second sleeve 203 can be attached through one or more curved sheets 204, as the spaces between each curved sheet 204 can define a portion of fracturing port 102. Inner surface of first sleeve 202 can have void 208 comprising an angular void 208*a* within the inner surface created by a gradually thinning wall of first sleeve 202, and a large void 208*b*. In one embodiment, void 208 can extend radially around the complete inner diameter of base pipe 100, partially around inner diameter. In another embodiment, voids 208 can exist only at discrete positions around the inner radius of first sleeve 202. If completely around inner diameter, the ends of inner surface can have a smaller diameter than the void 208. Angular voids 208*a* can each be above insert port 101 when sliding sleeve is in fracturing mode.

Figure 2D:
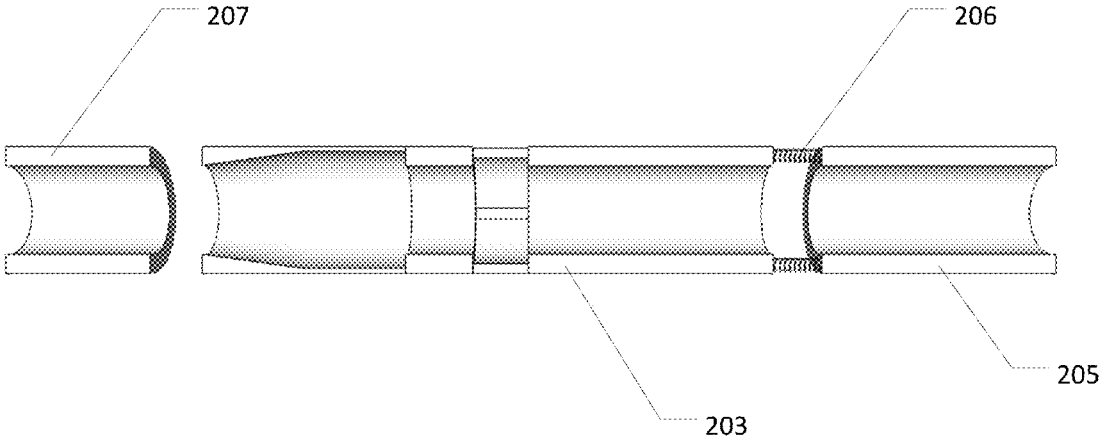
FIG. 2D illustrates a cross sectional view of a sliding sleeve that further comprises a fixed sleeve, and an actuator.

FIG. 2D illustrates a cross sectional view of a sliding sleeve 200 that further comprises a fixed sleeve 205, and an actuator 206. In one embodiment, actuator 206, can be a biasing device. In such embodiment, biasing device can be a spring. In another embodiment, actuator can be bidirectional and/or motorized. In one embodiment, second sleeve 203 of sliding sleeve 200 can be attached to fixed sleeve 205 using actuator 206. In one embodiment, sliding sleeve 200 can be pulled towards fixed sleeve 205, thus compressing load actuator 206 with potential energy. Later, actuator 206 can be released, or otherwise instigated, by pushing sliding sleeve 200 away from fixed sleeve 205.

Figure 3A:
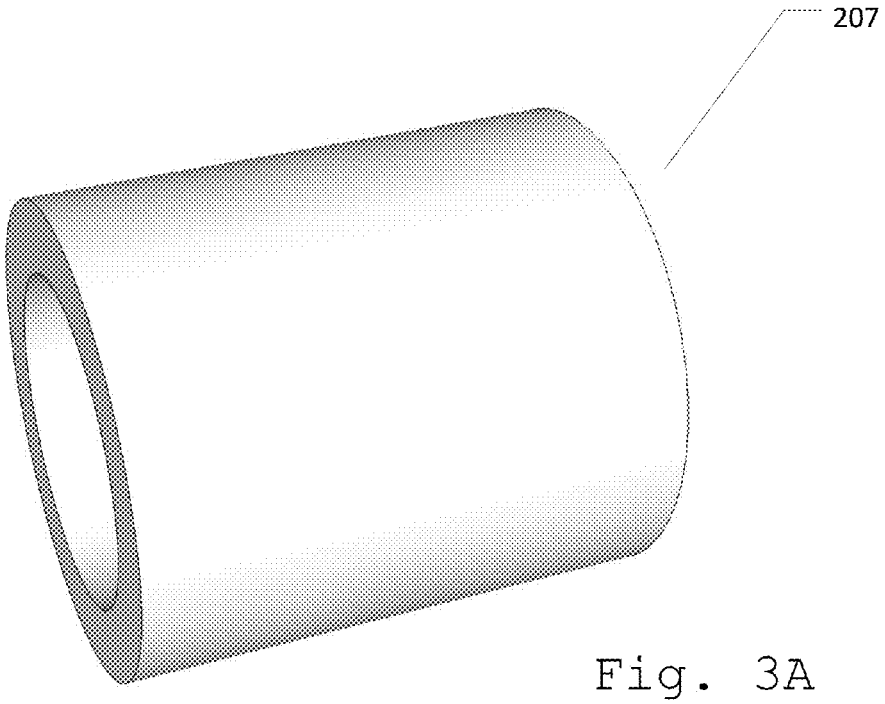
FIG. 3A illustrates a peripheral view of outer ring.
Figure 3B:
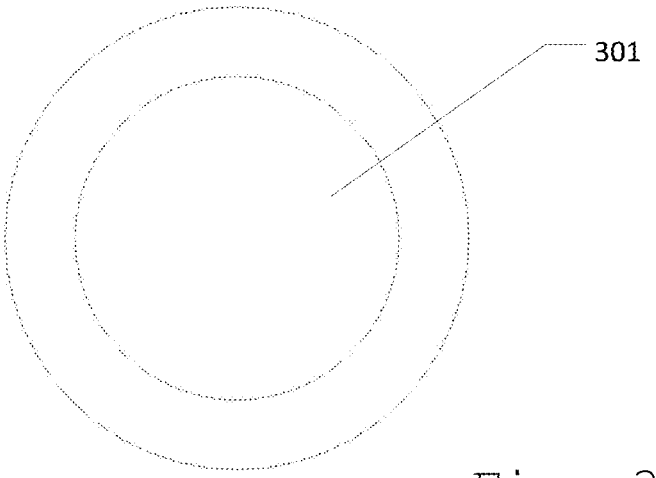
FIG. 3B illustrates a cross-sectional view of an outer ring.

FIG. 3A illustrates a peripheral view of outer ring 207. FIG. 3B illustrates a front view of an outer ring 207. In one embodiment, outer ring 207 can be a solid cylindrical tube forming a ring chamber 301, as seen in FIG. 3B. In one embodiment, outer ring 207 can be an enclosed solid material forming a cylindrical shape. Ring chamber 301 can be the space formed inside outer ring 207. Furthermore, ring chamber 301 can be large enough to slide over base pipe 100.

Figure 4A:
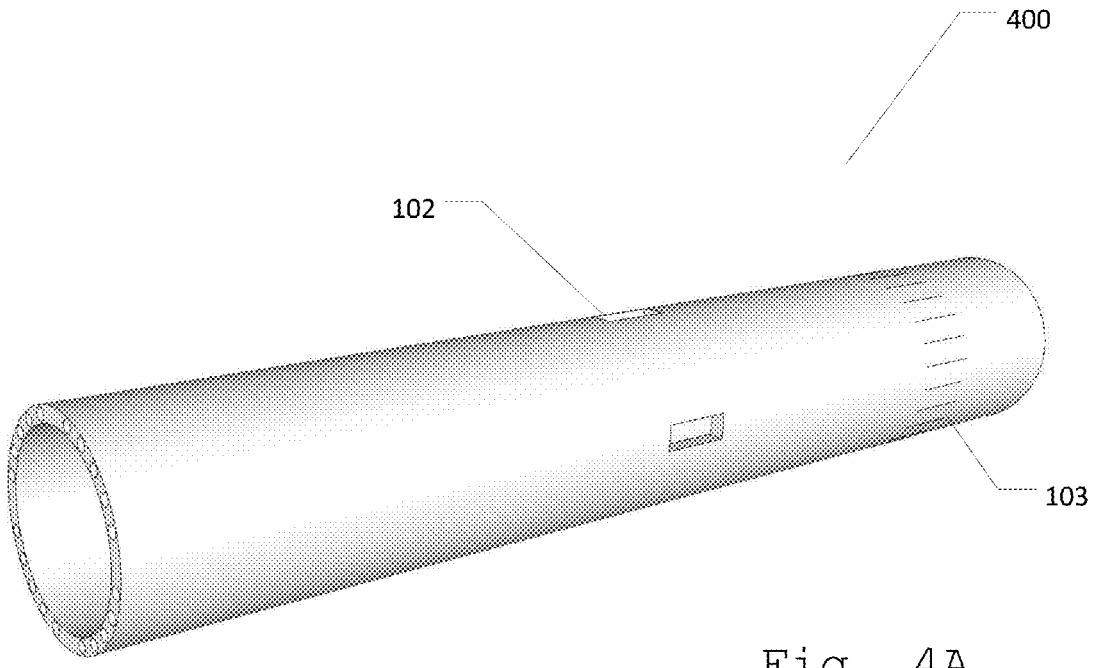
FIG. 4A illustrates a valve casing.
Figure 4B:
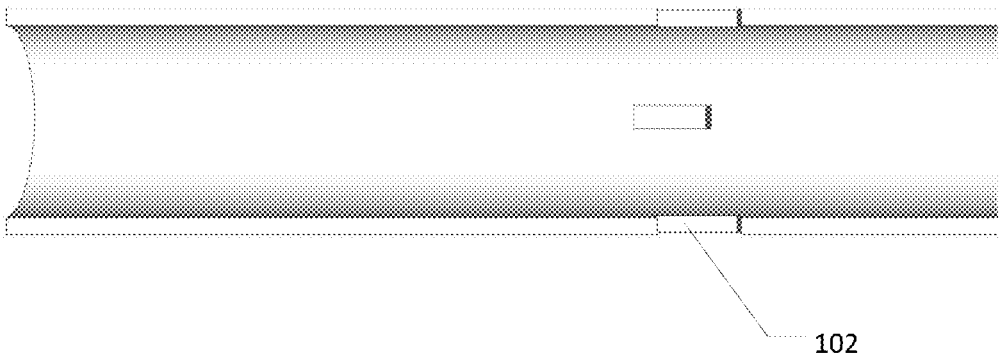
FIG. 4B illustrates a fracturing port of a valve casing.
Figure 4C:
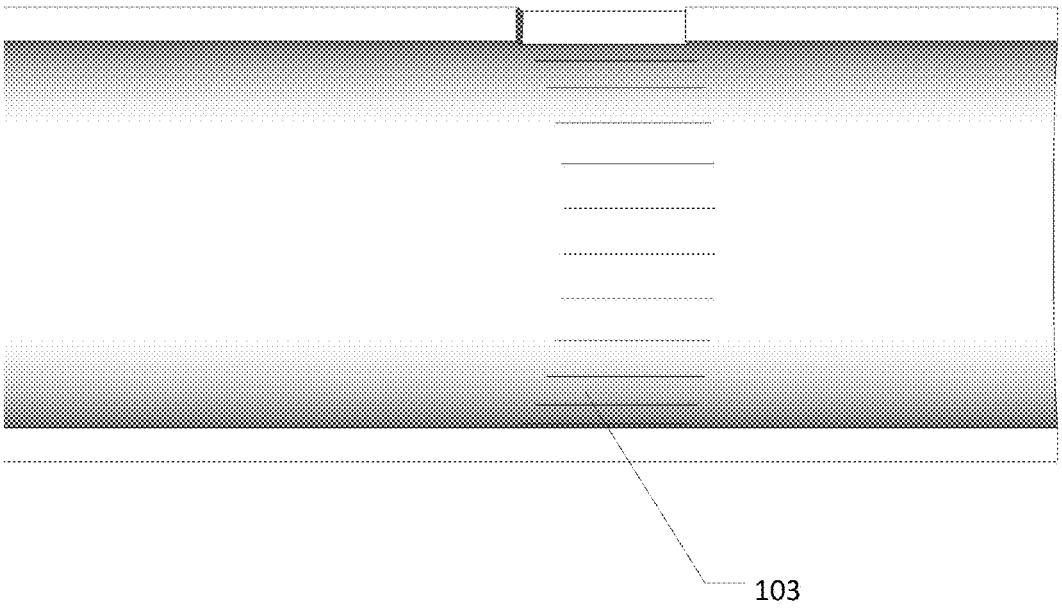
FIG. 4C illustrates a production slot of a valve casing.

FIG. 4A illustrates a valve casing 400. In one embodiment, valve casing 400 can be a cylindrical material, which can comprise fracturing port 102, and production port 103. FIG. 4B illustrates a fracturing port of a valve casing. In one embodiment, fracturing port 102 can be a plurality of openings circularly placed around valve casing 400, as seen in FIG. 4B. FIG. 4C illustrates a production slot of a valve casing. Furthermore, production port 103 can be one or more openings placed around valve casing 400, as seen in FIG. 4C.

Figure 5:
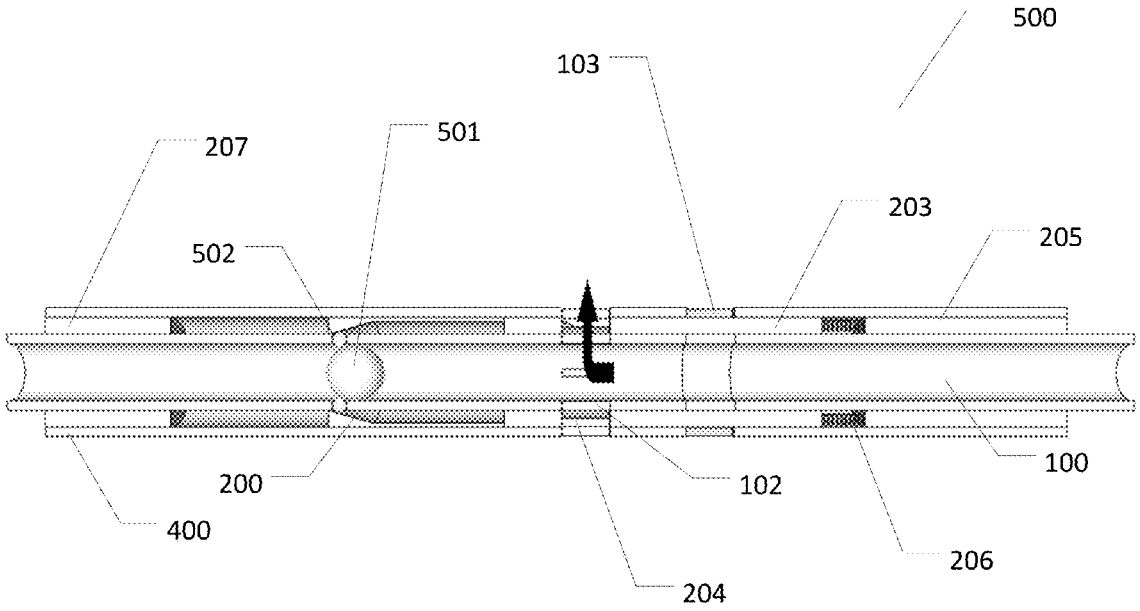
FIG. 5 illustrates a fracturing valve in fracturing mode.

FIG. 5 illustrates a fracturing valve 500 in fracturing mode. In one embodiment, fracturing valve 500 can comprise base pipe 100, sliding sleeve 200, outer ring 207, and/or valve casing 400. In such embodiment, base pipe 100 can be an innermost layer of fracturing valve 500. A middle layer around base pipe 100 can comprise outer ring 207 fixed to base pipe 100 and sliding sleeve 200, in which fixed sleeve 205 is fixed to base pipe 100. Fracturing valve 500 can comprise valve casing 400 as an outer later. Valve casing 400 can, in one embodiment, connect to outer ring 207 and fixed sleeve 205. In a fracturing position, fracturing port 102 can be aligned and open, due to the relative position of base pipe 100 and sliding sleeve 200.

Fracturing valve 500 can further comprise a frac ball 501 and one or more stop balls 502. For purposes of this disclosure, stop ball 501 can be any shaped object capable of residing in fracturing valve 500 that can substantially prevent frac ball 501 from passing. Further frac ball 501 can be any shaped object capable of navigating at least a portion of base pipe 100 and, while being held in place by stop balls 502, restricting flow. In one embodiment, stop ball 502 can rest in insert port 101. At a fracturing state, actuator 206 can be in a closed state, pushing stop ball 502 partially into chamber 104. In such state, frac ball 501 can be released from the surface and down the well. Frac ball 501 can be halted at insert port 101 by any protruding stop balls 502, while fracturing valve 500 is in a fracturing mode. As such, the protruding portion of stop ball 502 can halt frac ball 501. In this state, fracturing port 102 will be open, allowing flow of proppants from chamber 104 through fracturing port 102 and into a formation which allows fracturing to take place.

Figure 6A:
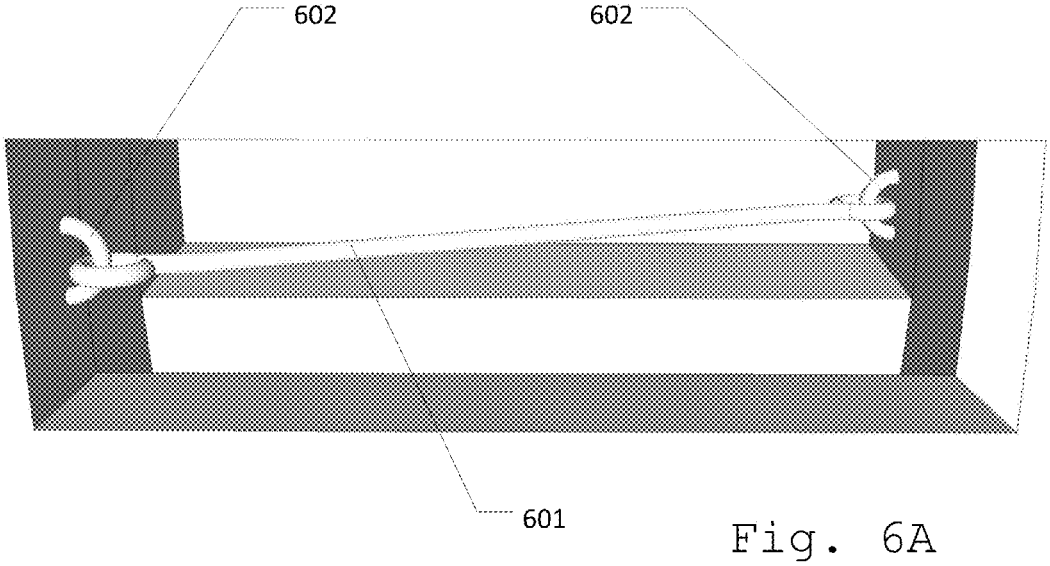
FIG. 6A illustrates an embodiment of an impedance device.

FIG. 6A illustrates an embodiment of an impedance device. Impedance device can counteract actuator 206, in an embodiment where actuator 206 is a biasing device, such as spring. In one embodiment, an erosion device in the form of a string 601 can be an impedance device. In such embodiment, string 601 can be made of material that can break, erode, or dissolve, for example, when it is exposed to a strong force, or eroding or corrosive substance. A string holder 602 can be a material, such as a hook or an eye, attached onto sliding sleeve 200 and base pipe 100. String 601 can connect sliding sleeve 200 with base pipe 100 through string holder 602. While intact, string can prevent actuator 206 from releasing. Once the string is broken, broken, actuator 206 can push sliding sleeve 601. One method of breaking string 601 can comprise pushing a corrosive material reactive with string through fracturing port, deteriorating string 601 until actuator 206 can overcome its impedance.

Figure 6B:
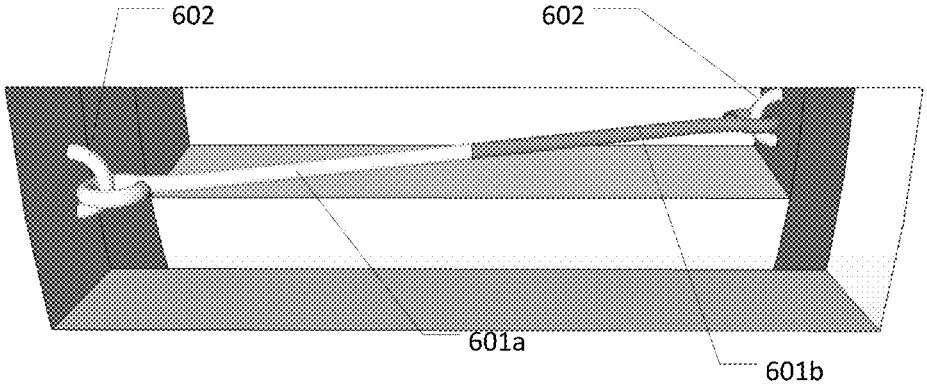
FIG. 6B illustrates another embodiment of an impedance device.

FIG. 6B illustrates another embodiment of an impedance device. In such embodiment, string 601 can comprise a first segment 601*a* and a second segment 601*b*. String holder 602 can connect first segment 601*a* with base pipe 100, while second segment 601*b* can attach to string holder 602 that connects with sliding sleeve 200. In such embodiment, any axial force applied, to sliding sleeve can put a tensile force on the impedance device. First segment 601*a* can be made of material that can be immune to a corrosive or eroding substance, but designed to fail at a particular tensile force, while second segment 601*b* can be made of material reactive to corrosive or erodable substance, that will fail at an increasingly lower tensile force. Such failure force gradient of second segment can be initially be higher than a failure force related to first segment 601*a*, but eventually decrease below it over time. As such, first segment 601*a* can be a portion of impedance device that can break when exposed to failure force, regardless of the extent to which second segment 601*b* has been dissolved.

Figure 7:
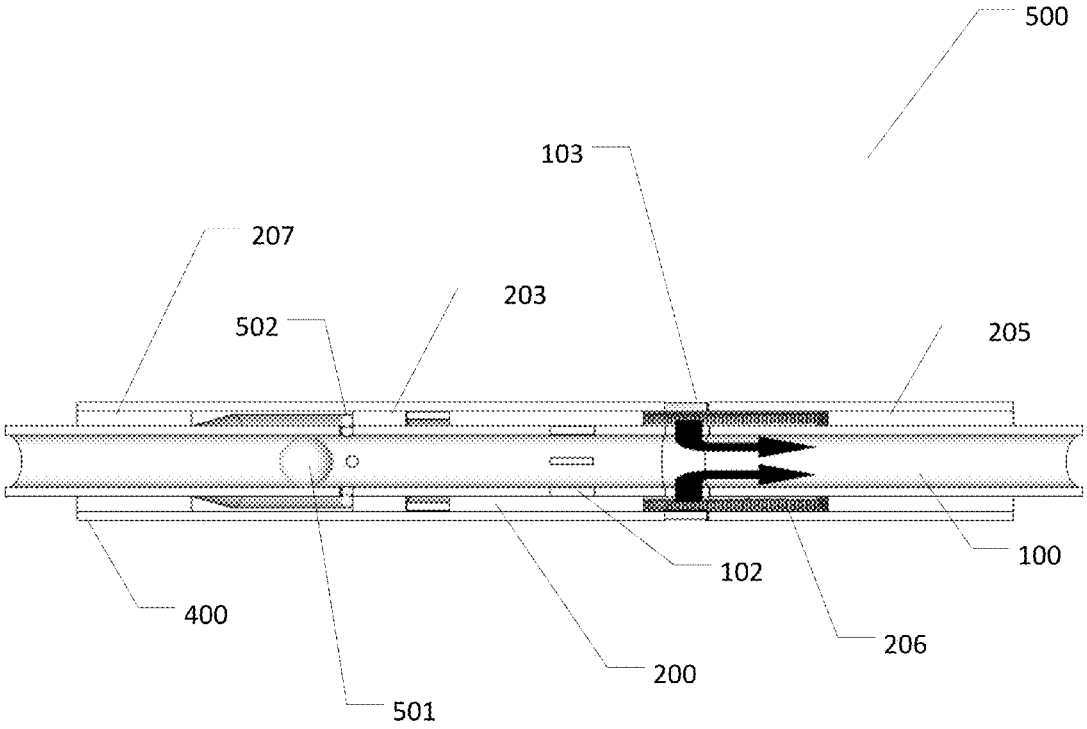
FIG. 7 illustrates fracturing valve in production mode.

FIG. 7 illustrates fracturing valve 500 in production mode. As sliding sleeve 200 is pushed towards outer ring 207 by actuator 206, fracturing port 102 can close, and production port 103 can open. Concurrently, second force by frac ball 501 can push stop balls 502 back into the inner end of first sleeve 202, which can further allow frac ball 501 to slide through base pipe 101 to another fracturing valve 500. Once production port 103 is opened, extraction of oil and gas can start. In one embodiment, production ports can have a check valve to allow fracturing to continue downstream without pushing fracturing fluid through the production port.

Figure 8A:
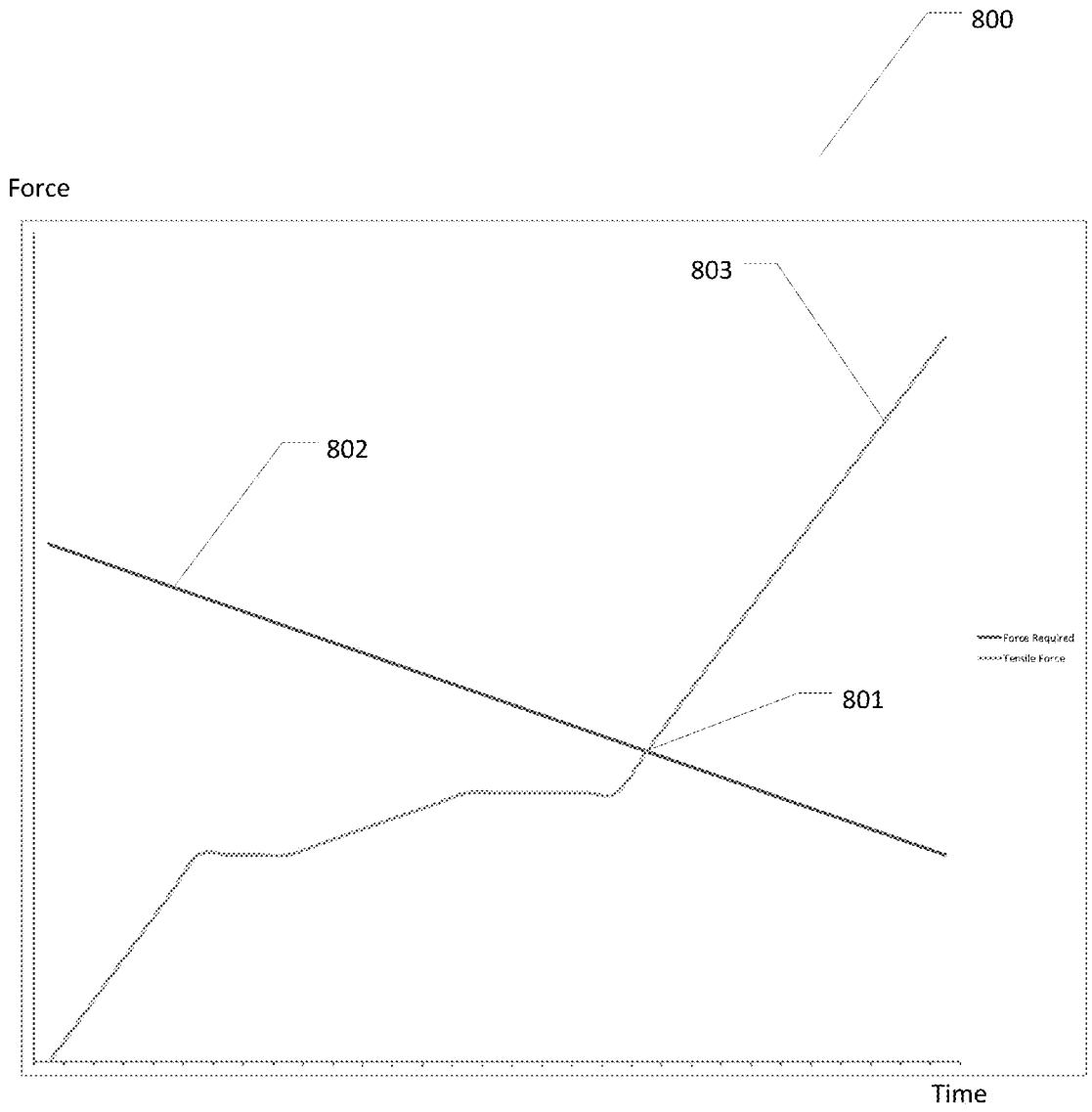
FIG. 8A illustrates a graph showing a breakage point of a string.

FIG. 8A illustrates a graph 800 showing a breakage point 801 of string 601. As mentioned in the discussion of FIG. 6A, string 601 can be made to dissolve over the course of the fracturing. In graph 800, x-axis can signify time, while y-axis can signify force. Graph 800 displays a line graph for a string strength line 802 and a string tensile force line 803. String strength line 802 can represent force required to break string 601 over time. String strength line 802 can be a straight line that starts high but decreases over time. The string strength line 802 indicates that string 601 can slowly dissolve or erode, as it gets thinner from the injected corrosive material in fracturing valve 500. Thus, the amount of force required to break string 601 can decrease over time. String tensile force line 803 can be the tensile force on string 601. The tensile force can be the force of the actuator 206 and the axial force of stop balls 501 related to the pressure of the well. When in fracturing state, a highly pressurized fracturing fluid can be injected into the fracturing port 102 and into a formation. Once the formation fractures, the pressure on frac ball 501 can level or drop off. Thus, more fracturing fluid can be injected into the formation with little change in pressure. After a period of time, the formation can fill up and no longer take fracturing fluid. At that point, pressure begins increasing again as more fluid is pushed into wellbore. The changes in pressure in the wellbore directly affect the tension on the line, as shown in string tensile force line 803. The point where string strength line 802 and string tensile force line 803 meet is a breakage point 801 for string 601.

To prevent screen-out, in one embodiment, a pressure sensor can be placed down well. Pressure sensor can be capable of reading pressure or determining when pressure reaches a threshold. Once threshold point is reached, pressure sensor can send signal to a computer, which can control sliding sleeve 200 by actuator 206. As a result, computer can cause sliding sleeve 200 to actuate as a result of commands to actuator 206. In one embodiment, actuator 206 can comprise a motor, which can generate the necessary force to move sliding sleeve 200 from a fracturing position to a production position.

Figure 8B:
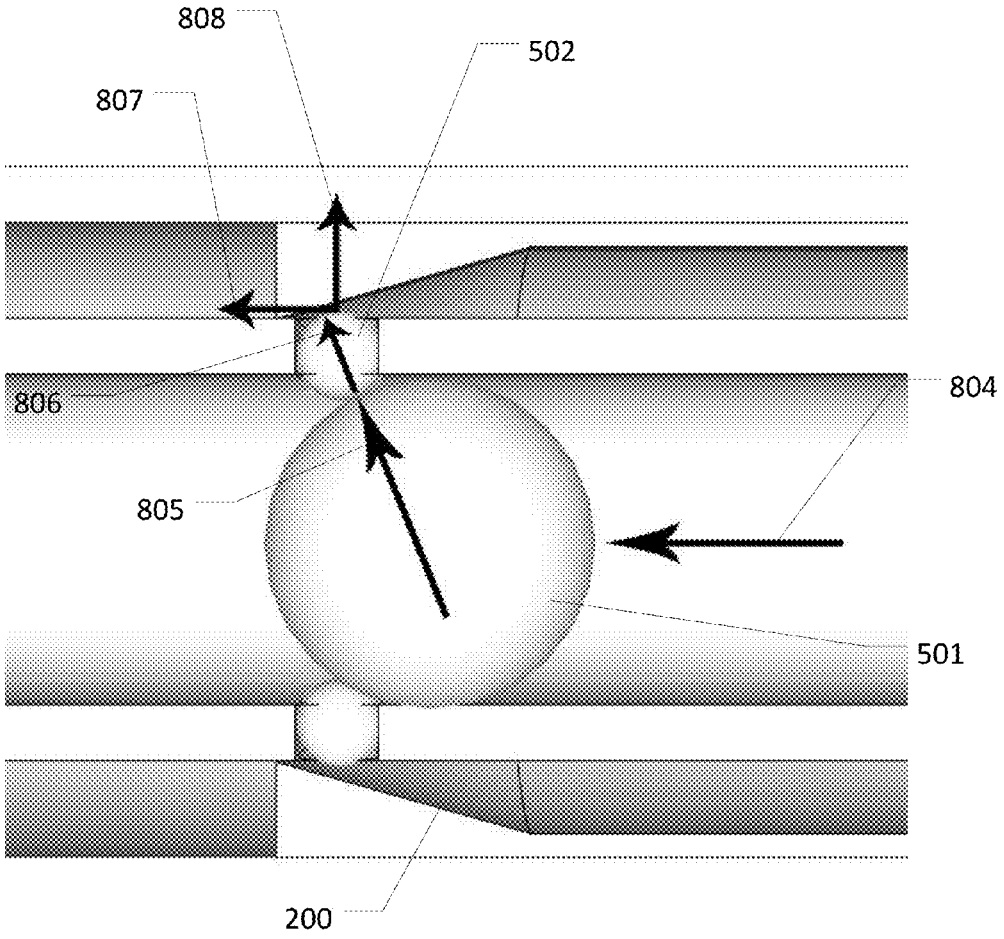
FIG. 8B illustrates a close up view of a fracturing valve in a fracturing mode.

FIG. 8B illustrates a close up view of fracturing valve 500 in fracturing mode. Wellbore pressure will push frac ball 501 down into chamber 104 by a first force 804. As fracturing ball 501 rests against stop ball 502, the pressure on frac ball 501 can cause stop ball 502 to push towards sliding sleeve 200. Frac ball 501 can push stop ball 502 with a second force 805, causing stop ball 502 to go into the angular inner wall of sliding sleeve 202. A third force 806 of stop ball 502 can build up against the wall of angular void 208*a*. The result is a radial force 808 in the radial direction of sliding sleeve 202, and an axial force 807 in an axial direction of base pipe 100, toward outer ring 207. The force in either direction depends on the angle of the angular void 208. A greater angle produces more force in the axial direction.

As the force on actuator 206 and the axial force 807 that ultimately results from the pressure on frac ball 501 is building, the axial force needed to break string 601 decreases due to string deterioration. As such, the point where string strength line 802 and string tensile force line 803 cross is breakage point 801. At breakage point 801, string 601 finally gives in to the tensile force and breaks. When over insert port, angular void 208*a* can prevent stop balls from exiting chamber 104. When large void 208*b* is over insert port, it can allow stop balls to exit chamber 104.

Figure 8C:
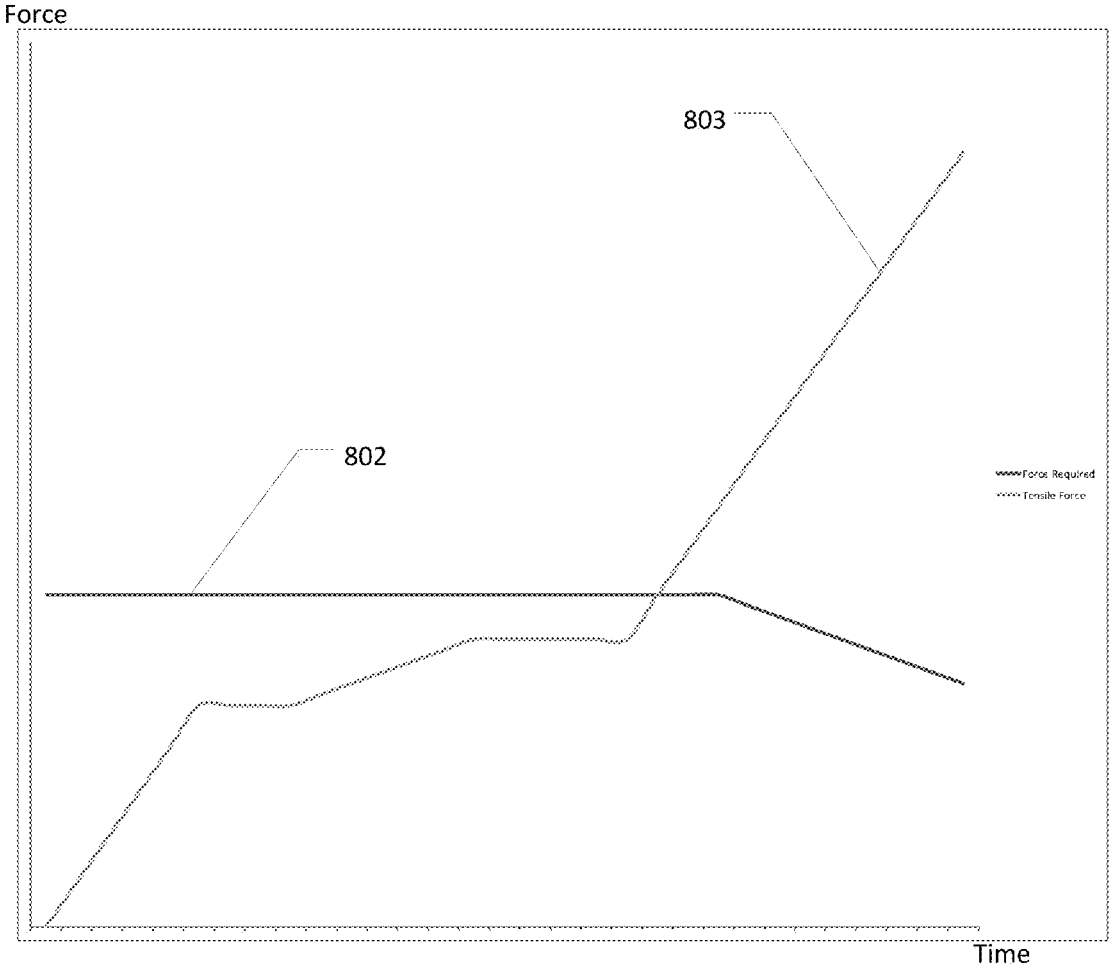
FIG. 8C illustrates a graph showing a breakage point of a segmented embodiment of an impedance device.

FIG. 8C illustrates a graph 804 showing breakage point 801 for a segmented embodiment of string 601. As discussed in FIG. 6B, string 601 can break at a required force or through exposure to corrosive substance. In graph 804, string strength line 802 can start with a flat horizontal line that eventually or gradually decreases over time. First segment 601*a* can be represented with the flat string strength line 802 that shows first segment 601*a* is breakable when a certain amount of force is applied. A decrease in strength of string 601 in strength line 802 can relate to second segment 601*b* of string 601 dissolving to a point where it eventually becomes weaker than first segment. When in fracturing mode, the increase and decrease in pressure can also affect the tension on string 601. As such, breakage point 801 is where string strength line 802 and string tensile force line 803 meets.

Figure 8D:
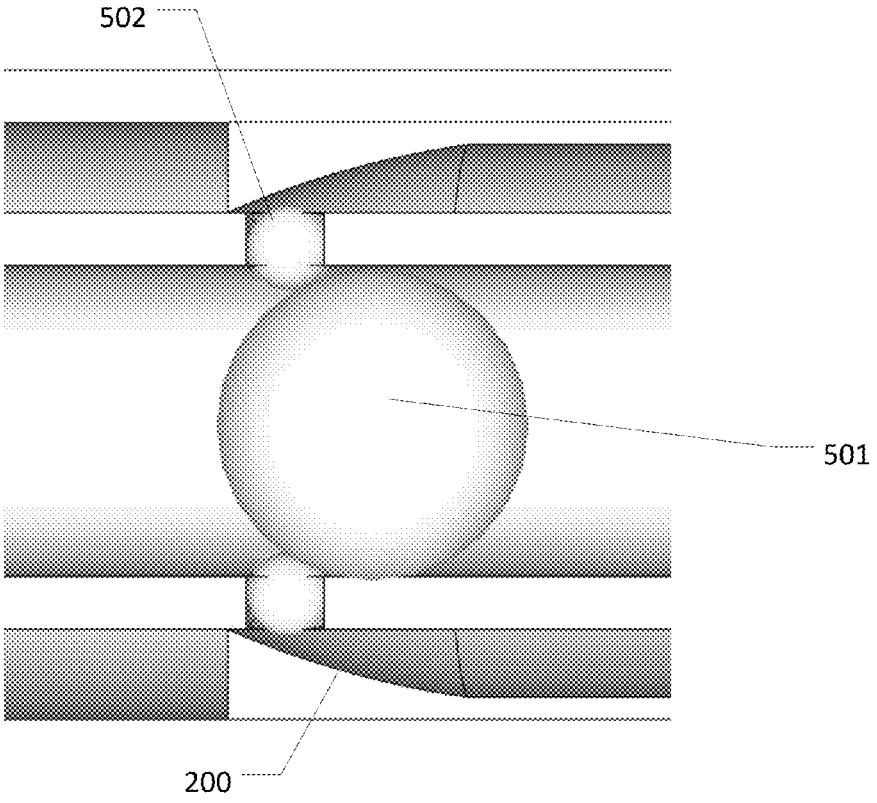
FIG. 8D illustrates another embodiment of fracturing valve in fracturing mode.

FIG. 8D illustrates another embodiment of fracturing valve 500 in fracturing mode. In such embodiment, inner surface of first sleeve 202 can have a curved void 208 within the inner surface, radially creating an exterior curvature of first sleeve 202. In fracturing mode, curved void 208 can be above insert port 101. The slope within the inner surface of first sleeve 202 can cause stop ball 502 to overcome the force on string 601 easier. A steep angle creates more force in the axial direction. As such, frac ball 501 can require less force to push stop ball 502 into the curved inner wall of sliding sleeve 202.

Various changes in the details of the illustrated operational methods are possible without departing from the scope of the following claims. Some embodiments may combine the activities described herein as being separate steps. Similarly, one or more of the described steps may be omitted, depending upon the specific operational environment the method is being implemented in. It is to be understood that the above description is intended to be illustrative, and not restrictive. For example, the above-described embodiments may be used in combination with each other. Many other embodiments will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein."

The invention claimed is:

1. A fracturing valve system comprising a base pipe comprising a fracturing port first portion and an insert port capable of housing a stop ball, said stop ball insertable partially within the chamber of said base pipe;

a sliding sleeve comprising a first sleeve, said first sleeve comprising an inner surface, said inner surface comprising an angular void and a large void, said first sleeve maneuverable into a first position, wherein said angular void rests over said insert port, preventing said stop ball from exiting the chamber of said base pipe; and a second position, wherein said large void rests over said insert port, said stop ball capable of exiting the chamber of said base pipe, to enter said large void;

a second sleeve;

a fracturing port second portion; and one or more curved sheets, said one or more curved sheets connecting said first sleeve to said second sleeve, wherein the space between said one or more curved sheets defines said fracturing port second portion.

2. The fracturing valve system of claim 1 further comprising a string, the first end of said string connected to said base pipe, the second end of said string connected to said sliding sleeve, said string within said fracturing port first portion and fracturing port second portion.

3. The fracturing valve system of claim 1, wherein said base pipe further comprises a production port.

4. The fracturing valve system of claim 1, wherein said sliding sleeve, while in said first position, said fracturing port first portion aligns with said fracturing port second portion; and said second position, said fracturing port first portion does not align with said fracturing port second portion.

5. The system of claim 1 wherein said angular void is curved.

6. A method of detecting screen out using a fracturing valve comprising injecting a fracturing fluid into said fracturing valve, said fracturing valve comprising a base pipe and a sliding sleeve, said base pipe comprising one or more insert ports each capable of housing a stop ball, said sliding sleeve comprising an inner surface, said inner surface comprising an angular void and a large void said sliding sleeve initially in a first position, wherein said angular void rests over said insert port;

applying a first force on said frac ball by said fracturing fluid;

applying a second force on said one or more stop balls by said frac ball;

applying a third force against said angular void by said stop balls;

biasing said sliding sleeve with an axial force, at least in part by said third force, toward a second position, said second position a second position, wherein said large void rest over said insert port, said stop ball capable of exiting the chamber of said base pipe, to enter said large void; and breaking a string attached on said sliding sleeve and a base pipe, wherein said string releases said sleeve toward said second position.

7. The method of claim 6, wherein said string comprises a first portion and a second portion, said first portion dissolvable, said second portion non-dissolvable.

8. The method of claim 6, wherein said string comprises a first portion and a second portion, said first portion erodable, said second portion non-erodable.

* * * * *